US005575458A

United States Patent [19]

Kingham

[11] Patent Number: 5,575,458

[45] Date of Patent: Nov. 19, 1996

[54] MESH STRUCTURE

[76] Inventor: Merle Kingham, 8966 E. Voltaire Dr., Scottsdale, Ariz. 85260

[21] Appl. No.: 238,915

[22] Filed: May 6, 1994

[51] Int. Cl.[6] ..... E04H 17/04

[52] U.S. Cl. ..... 256/45; 256/46; 245/8

[58] Field of Search ..... 286/45, 46, 32, 286/5, 6, 9, 24, 1, 12.5; 140/11; 245/5, 8; 428/221, 224, 225

[56] References Cited

U.S. PATENT DOCUMENTS

| | | | |
|---|---|---|---|
| 522,536 | 7/1894 | Shellaberger | 245/8 |
| 591,294 | 10/1897 | Purdy et al. | 245/8 |
| 1,821,731 | 9/1931 | Sommer | 256/5 |
| 4,157,411 | 6/1979 | Thomson | 140/11 X |

FOREIGN PATENT DOCUMENTS

| | | | |
|---|---|---|---|
| 494662 | 7/1953 | Canada | 256/45 |
| 502511 | 7/1930 | Germany | 245/8 |

*Primary Examiner*—Kenneth J. Dorner
*Assistant Examiner*—Harry C. Kim
*Attorney, Agent, or Firm*—Perman & Green

[57] ABSTRACT

An improved mesh structure and method of making same uses a border to define the a general mesh shape and a first and a second plurality of a lengths of strand doubled back upon themselves so as to connect with the border member at points where each strand doubles back which results in an overall reduction of material of the mesh. The method of fabricating the mesh structure includes providing an alignment means to cause the first and second plurality of a lengths of cable to be doubled back upon themselves so as to create an intermediate length and two longitudinal lengths spaced apart from one another by the length of the intermediate length which pierce the border member at point corresponding to the length of the intermediate length of the doubled back strands.

9 Claims, 4 Drawing Sheets

MESH STRUCTURE

BACKGROUND OF THE INVENTION

This invention relates to a mesh structure, and deals more particularly with an improvement to such structures whereby the strands of the mesh structure are interconnected in such a way with one another as to effect enhanced strength of the overall mesh structure using less strand length for a given load capacity.

In creating mesh structures, it has often been found that the single most known way to fabricate mesh structures is to use continuous lengths of strands which cross one another at ninety degree intersections at points called nodes which are repeatedly spaced from one another relative to some given origin. However, since the cost of fabricating such structures is directly related to the amount of material used in any given job, it is therefore desirable to minimize the amount or length of strands used to create a given mesh structure. In the heretofore mentioned known mesh structures, it is common to create the nodes by knotting intersecting strands or by other complicated locking of the members about each other to effect the creation of a nodal points which are stationary taken relative to the remaining nodes in the mesh structure and to the given origin. The creation of these knots involves the repeated making of knots at uniform intervals. Therefore, it is not desirable to use a method of creating a mesh which mandates the node by node knotting of the intertwined strands because it is unduly burdensome from a fabrication standpoint and requires the entire strand lengths used throughout the structure be pulled through each knot.

Mesh structures of the type which the present invention is concerned must be sufficiently strong in the many directions with which they are loaded in order to withstand the many different types of loadings with which they are subjected. Mesh structures many take many different types of applications, and, in particular, mesh structures of the type which the present invention is concerned is particularly useful in the creation of wildlife containment barriers and therefore must have sufficient strength to keep the involved wildlife from escaping or from partially severing the mesh structure and thereafter clawing or otherwise harming a bystander.

Accordingly, it is an object of the invention to provide a mesh structure made from a method whereby strand length is conserved and the hitherto known process of knotting intertwined strands is avoided.

It is still a further object of the invention to provide a mesh structure of the aforementioned type which is particularly well suited for high strength containment or safety barriers.

A still further object of the invention is to provide a mesh structure of the aforementioned type formed from a method particularly suited for the creation of a mesh structure using wire cable strands.

Further objects and advantages will become apparent from the following disclosure in the appended claims.

SUMMARY OF THE INVENTION

The invention resides in an improved mesh structure comprising a border member having a first given dimension taken in one direction and a second given dimension taken in a second direction which first and second dimensions defining the general shape of the mesh structure. A plurality of longitudinally and transversely oriented strands are connected at least in part to the border member such that each of the longitudinally oriented strands being disposed generally parallel to one another and to the first given dimension of the border and the plurality of the transversely oriented strands being disposed parallel to one another and to the second dimension of the border such that the longitudinally oriented strands and the transversely oriented strands together intersect one another at given intervals. Consecutively order pairs of the transverse strands and consecutively ordered pairs of the longitudinal strands each being comprised of a single strand length doubled back on itself so as to form an intermediate strand length disposed generally orthogonally to the doubled back strand lengths of the involved single strand length. The doubled back strand lengths of each of the transverse and the longitudinal strands extend with the first given dimension and with the second given dimension, respectively. Each consecutively ordered pair of the transverse strands and each consecutively ordered pair of the longitudinal strands being connected to the border member such that the doubled back strand lengths of each of the consecutively order pair of the transverse strands and each consecutively ordered pair of the longitudinal strands connect with the border member at two spaced points corresponding to the length of the intermediate strand length associated with each consecutively ordered pair of the transverse strands and each consecutively ordered pair of the longitudinal strands. The intersecting longitudinal and transverse strands being secured against local relative movement by fastening means for interconnecting the transverse and the longitudinal strands to one another. The free ends of the consecutively order pairs of the transverse strands and each consecutively ordered pair of the longitudinal strands being connected to the border member or to a juxtaposed transverse strand or longitudinal strand by a means which locks the connected members to one another.

The invention further resides in a method of making a mesh structure of the aforementioned type by providing a means having a bed for supporting mesh material thereon in a substantially planar manner; providing alignment means on the bed defining an alignment area thereon defined by a first and second dimension disposed orthogonally to one another; providing the border member such that it defines the general shape taken by the mesh structure; providing a first plurality of a lengths of cable to be used as transverse strands each having a length which is generally twice the dimension of one of the given dimensions of the alignment area; providing a second plurality of a lengths of cable to be used as longitudinal strands each having a length which is generally twice the overall length dimension of the mesh structure; using the alignment means to double the lengths of the first plurality of strands such that the doubled back lengths of the first plurality of strands are oriented parallel to one another and using the alignment means to double the lengths of the second plurality of strands such that the doubled back lengths of the second plurality of strands are oriented parallel to one another and to the other of the first and second given dimensions so that the strands of the first plurality intersect with the strands of the second plurality; and fastening the intersecting ones of the first and second plurality of strands to one another while being held in place on the bed.

DETAILED DESCRIPTION OF THE PREFERRED EMBODIMENTS

Figure 1:
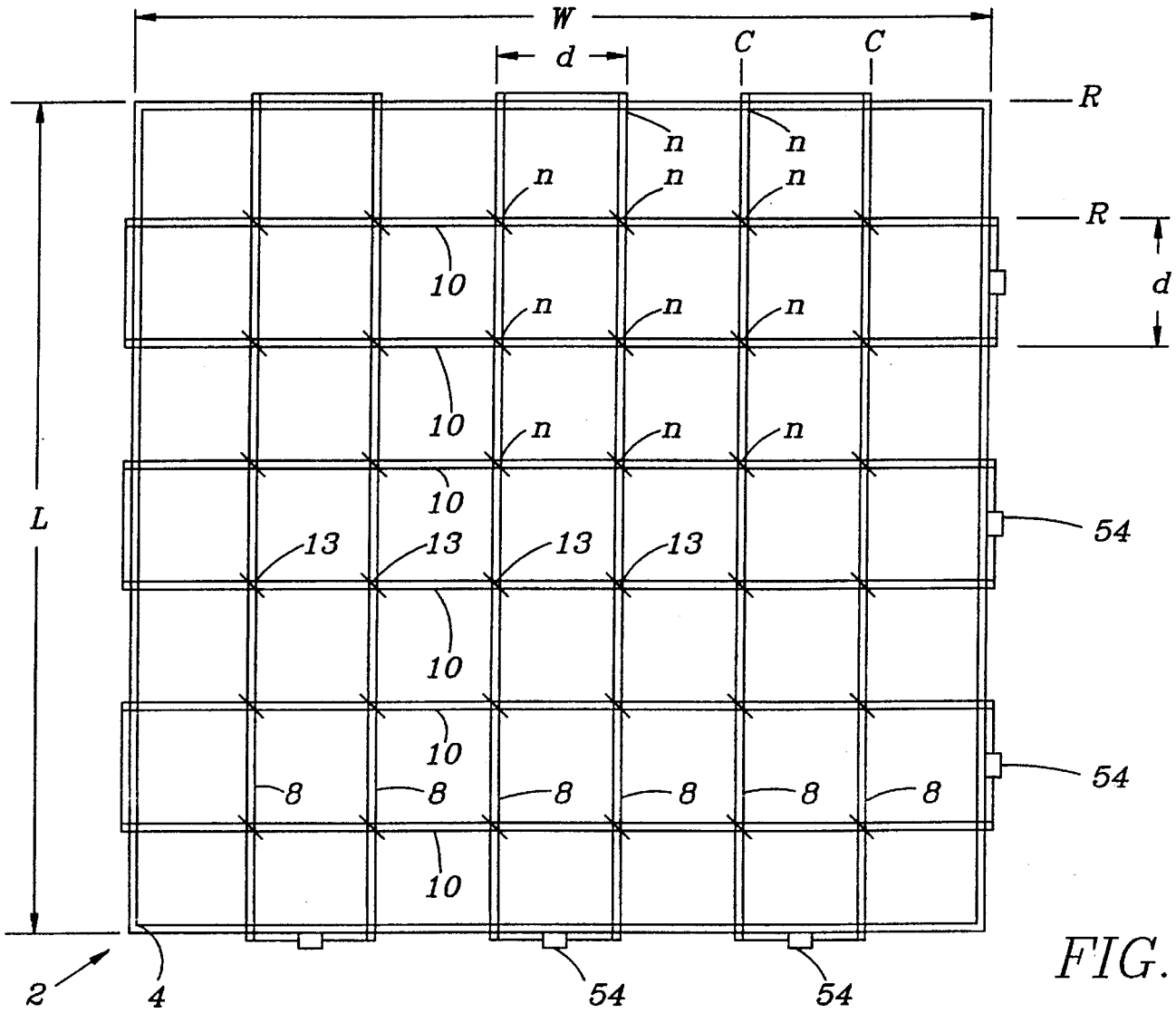
FIG. 1 is a plan view of a mesh structure.

FIG. 1 illustrates a mesh structure embodying the invention and illustrated generally as 2. The mesh structure 2 includes a border member 4 which defines generally the shape of the mesh structure. The mesh structure 2 has a longitudinal dimension L and a width dimension W extending orthogonally to one another such that the longitudinal and the transverse dimensions each combine to give the structure its given shape. Associated with the longitudinal dimension L of the mesh are a plurality of equidistantly spaced longitudinal strands 8,8 each extending generally parallel to the longitudinal dimension L of the mesh. Likewise, associated with the width dimension W are a plurality of generally equidistantly spaced transverse strands 10,10 each extending generally parallel to the width dimension W and oriented orthogonally to the longitudinal strands 8,8. In the illustrated embodiment, the longitudinal and the transverse strands 8,8 and 10,10 are twisted high strength cable lengths which are capable of being locally partially unraveled to allow the passing of one strand through the other. The transverse and longitudinal strands intersect With one another at nodes n,n and are caused to be connected with one another at these nodes by a means 13,13. This means includes a steel C-clip which is crimped around the intersecting involved ones of the transverse and longitudinal strands so as to locally secure each intersecting strand against movement to the other. In the illustrated embodiment, the nodes n,n are spaced apart from one another in rows R and in columns C with the nodes of each column being equidistantly spaced from one another by the dimension d and from the corresponding neighboring nodes of the juxtaposed columns and the nodes of each row R being equidistantly spaced by the dimension d from neighboring nodes in the adjacently disposed rows R. Each longitudinal and transverse strand 8,8 and 10,10 connects the mesh structure 2 to the border member 4 in a manner which is important with respect to the method of fabrication of the overall mesh structure. However, for the moment it is only necessary to understand that the securement of the free ends of the strands 8,8 and 10,10 effect connection of the mesh to the border and act against fraying of the ends of the strands once secured.

Referring now to FIGS. 2–5, and to the method of fabricating the mesh structure of FIG. 1, it should be seen that the method includes providing a placement means 22 for arranging the longitudinal strands 8,8 and the transverse strands 10,10 of the mesh structure in a given orientation relative to one another so that each intersecting strand can be interconnected by the means 13 while being maintained in a given orientation prescribed by the placement means 22. In this way, the mesh structure is connected to the border member 4 so that the placement of the nodes n,n and their formation with respect to the given orientation of the strands is effected automatically by the assembler. The placement means 22 for this purpose includes a jig means 24 which includes a generally flat support bed 26 having a support surface 27 and a means 28 for aligning in part the longitudinal strands 8,8 with one another and for aligning substantially the full length of the transverse strands 10,10 of the mesh structure prior to fabrication in the given orientation.

Figure 2:
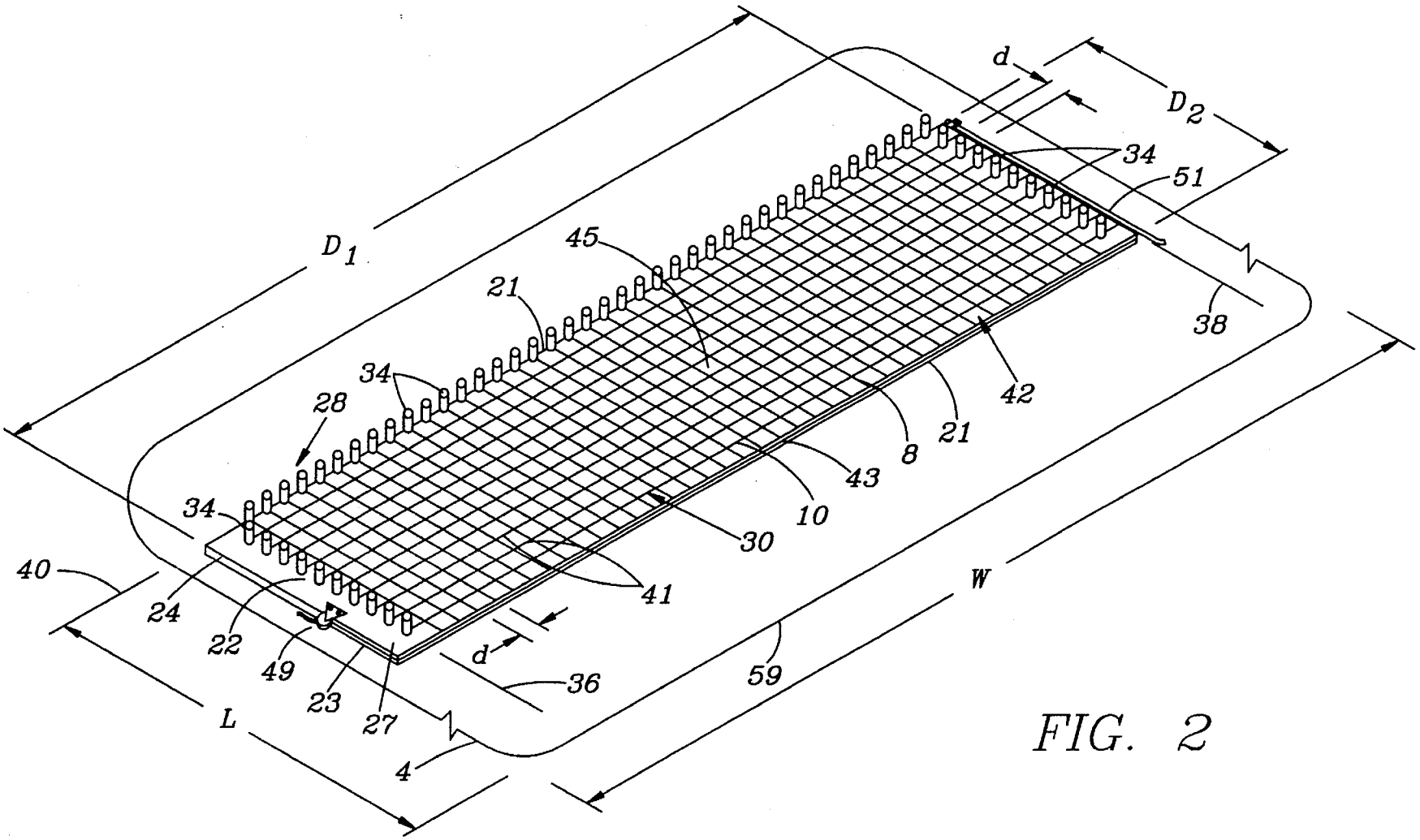
FIG. 2 is a perspective view of a jig used for creating the mesh structure of FIG. 1 with the border member disposed thereabout.

As illustrated in FIG. 2, the alignment area 30 has a substantially rectangular shape as defined by the dimension D1 corresponding to the long sides 21,21 of the rectangle and by the dimension D2 corresponding to the short sides 23,23 of the rectangle, with the long side being several times greater than the short side to create the substantially rectangular shape. Although illustrated in the preferred embodiment as being a rectangular shape, the area 30 may vary according to the needs of the mesh structure to be fabricated, and could alternatively take the form of a square shape, for example, depending on the size requirements of the mesh. It is important to note that in the preferred embodiment, the dimension D1 is selected so as to correspond to the one dimension of the mesh structure which would not be subject to change, such as, for example, the height dimension of a barrier fence. That is, in the case where the mesh structure is to be used as a barrier for wildlife, for example, the dimension D1 would correspond to the height of the structure taken from grade and would be constant as opposed to the length of the structure would correspond to multiples of the dimension D2 and would vary according to specification.

The alignment means 22 further includes a plurality of upstanding peg members 34,34 secured to the support bed 26 and stand tall about one inch above the surface 27 to create a generally U-shaped upstanding structure thereon. The peg members are arranged along three sides of the alignment area 30 so as to define the alignment area in terms of the dimensions D1 and D2. In the illustrated example, the borders of the support bed 26 are shown generally coincident with the dimensions of the alignment area 30, but it should nevertheless be understood that it is not critical that the edges of the bed 26 be limited by the dimensions of the alignment area. Rather, the bed may extend outside the alignment area an additional area many times greater than that of the alignment area 30 and still permit proper functioning of the alignment means 22. Certain of the pegs 34,34 are arranged in two parallel opposite rows 36 and 38 spaced apart from one another by the long dimension D1 of the alignment area. A third row 40 of the pegs 34,34 is arranged orthogonally to the two parallel disposed rows 36 and 38 so as to make up the transverse portion of the generally U-shaped upstanding structure which defines the alignment area 30. The side of the upstanding structure disposed oppositely of the third or transverse row 40 is left absent any peg member so as to provide an open side 42 in the upstanding structure opening oppositely of the third row 40.

The peg members 34,34 are spaced at regular intervals from one another along each of the rows 36, 38 and 40, which spacing between adjacently disposed ones of pegs coinciding with the dimensions d,d which separate the rows and columns of the nodes n,n from one another. The pegs are capable of being adjustably mounted to the support bed 26 to allow for different spacings as may be required between strands as defined by the dimension d and as set by mesh design. Disposed in association with the location of each peg member on the support bed is a visual positioning means 44 formed on the support surface 27 and defining a grid 45 on the alignment area 30. The grid is itself defined by a first series of straight parallel lines 41,41 oriented parallel to one another and to the dimension D1 and includes a second series of straight lines 43,43 oriented parallel to one another and to the dimension D2, with corresponding ones of the lines of each series respectively intersecting each other at locations corresponding to the position of the nodes n,n. These lines play an important role in the fabrication process of the mesh structure as the lines serve as a guide for use by workers in orienting the transverse and longitudinal strands in correct orientation so that a worker can effect connection at the proper node location which is prescribed by the intersecting ones of the lines of the grid 45. The support bed also includes a means for securing the longitudinal and transverse strands 8,8 and 10,10 against movement to the bed during the fabrication process, and, in the illustrated embodiment, is shown as a first clamping means 49 associated with the longitudinal strands 8,8 and a second clamping means 51 associated with the transverse strands 10,10.

In use, the alignment means 22 is used in the fabrication of the mesh structure by setting the border member around the support bed 26 such that given lengths of the border member are disposed in close proximity and in a parallel relationship with each of the first, second and third peg rows 36, 38 and 40 as seen in FIG. 2. This orientation results in the length L of the border 4 being disposed along the dimension D2, and which length L is several times in excess of the D2 dimension.

Figure 3:
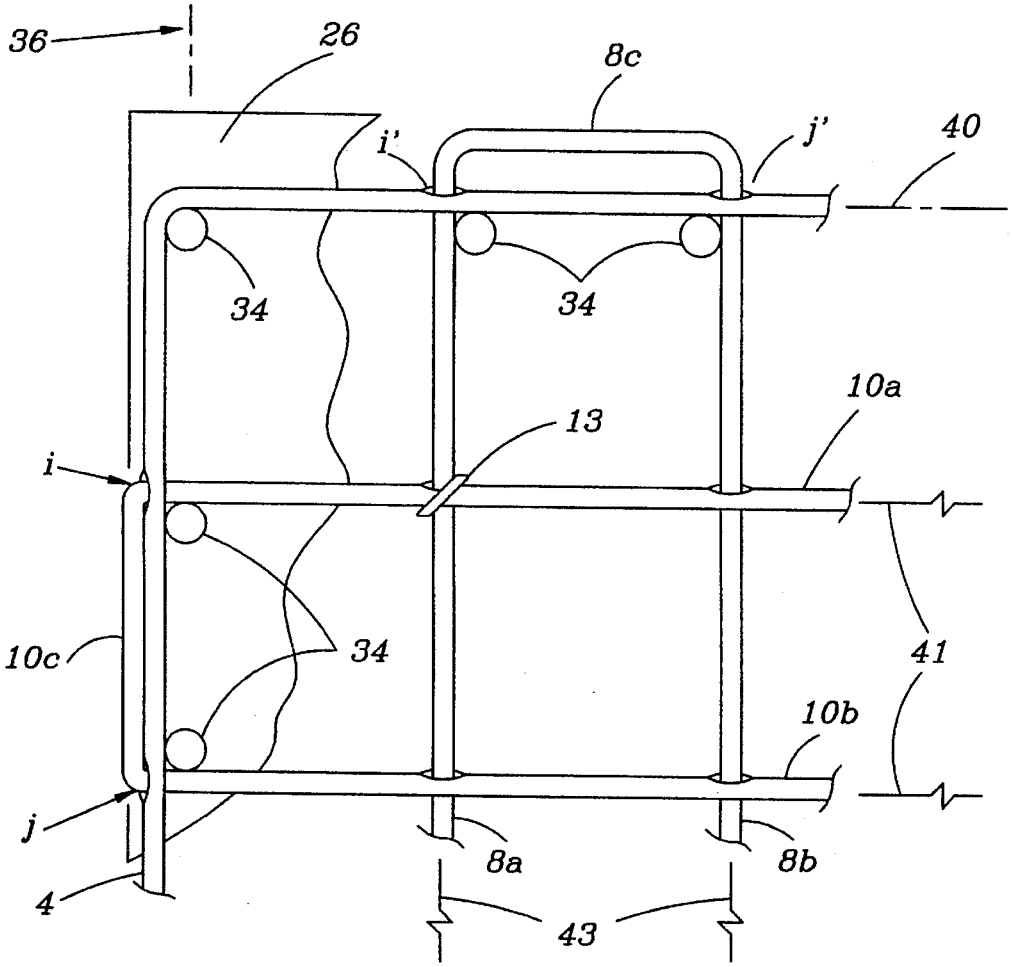
FIG. 3 illustrates a connection between a border piece and a double back transverse strand of the mesh structure as seen from the left side of the mesh.

Referring now to FIG. 3, it should be seen that each of the transverse and longitudinal strands 8,8 and 10,10 of the mesh structure is comprised of a one-half length of strand which is doubled back on itself and connected to the mesh structure through the border member 4. The first step in the fabrication of the mesh structure 2 is the connection of the longitudinal strands 8,8 and the transverse strands 10,10 with the border member 4. The transverse strands 10,10 of the mesh structure are assembled using successive pairs of the peg members 34,34 disposed along a selected one of the first and second rows 36 and 38 and a plurality of doubled back lengths of strand, which in the case of the transverse strands 10,10, are equal to about double the width dimension W of the mesh structure. Each strand 10 is defined by two equal doubled back portions **10*a* and 10*b* and an intermediate portion 10*c* straddling a successively ordered peg pair about which the strand length is turned. Each involved length of the doubled back strand is first turned around two consecutively ordered ones of the pegs associated with it and thereafter pierces the border member 4 at the illustrated points i and j. The longitudinal and transeverse strands in FIGS. 3 and 4, as previously mentioned, are steel cables which in the particular instance are made up of seven twisted substrands and the piercing of given ones of the subtrands involves the lifting of three locally grouped strands and the insertion of the piercing strand through the pierced strand between the lifted three substrands and the remaining four substrands. The transverse strand lengths 10*a* and 10*b* are arranged in a parallel relationship with one another and are aided in this process by the second series of lines 43,43 of the grid 45 which are used by the worker to visually orient each of the strands 10*a* and 10 in the intersecting arrangement called for by the grid 45. The free ends of the transverse strands 8,8 are then pulled tautly and clamped by the second clamping means 51** disposed along the corresponding side edge of the support bed.

The longitudinal strands 8,8 are likewise single strand lengths which have, a total length which is double the length L of the mesh structure. As best seen in FIG. 3, each strand 8 is defined by two equal doubled back portions **8*a* and 8*b* and an intermediate portion 8*c* straddling a successively ordered peg pair disposed along the row 40, about which the strand length is turned. In addition to being turned around an associated peg pair, each doubled back longitudinal strand 8*a* and 8*b* pierces the border member 4 at the illustrated points i' and j' in the manner illustrated in FIG. 3 and thereafter is caused to pierce the previously arranged transverse strands 10*a*,10*b* in the direction of the D2 dimension. The process of the combined orienting of the longitudinal strands 8,8 in a parallel relationship with one another and the piercing of the transverse strands 8*a* and 8*b* is aided by the first series of lines 41,41 of the grid 45 which are used by the worker to visually orient each of the strands 8*a* and 8*b* over respective ones of the lines 41,41 and select the appropriate point of entry for the longitudinal strand through the involved transverse strand length. Once each of the longitudinal strands 8,8 is passed through the intersecting transverse strands in this manner, the strands 8*a* and 8*b* are pulled tautly and clamped by the clamping means 49 to the support bed 26 to maintain this orientation. Any necessary last adjustment of the transverse and/or longitudinal strand lengths with respect to the underlying grid 45, may be made by sliding the involved ones of these strands relative to one another to effect the proper superposition of the strands over the grid. With both the transverse and longitudinal strands being maintained in place by the first and second clamping means 49 and 51, the worker(s) then fastens a deformable metallic C-clip about the intersecting transverse and longitudinal strands at the nodes n,n using a commercially available tool. It is noted that while the clamping means 49 and 51 are illustrated in the preferred embodiment as being devices having means such as a clamping bar or the like which is caused to compress against the associated side edges of the support bed 26** by the action of for example of an over the center lever, such devices are not important to the practice of the invention. Rather, clamping of the involved ones of the longitudinal and transverse strands to the associated edges of the support bed may simply be effected using a plurality of vice-grip pliers which separately clamp the involved strand length against the support bed.

Figure 4:
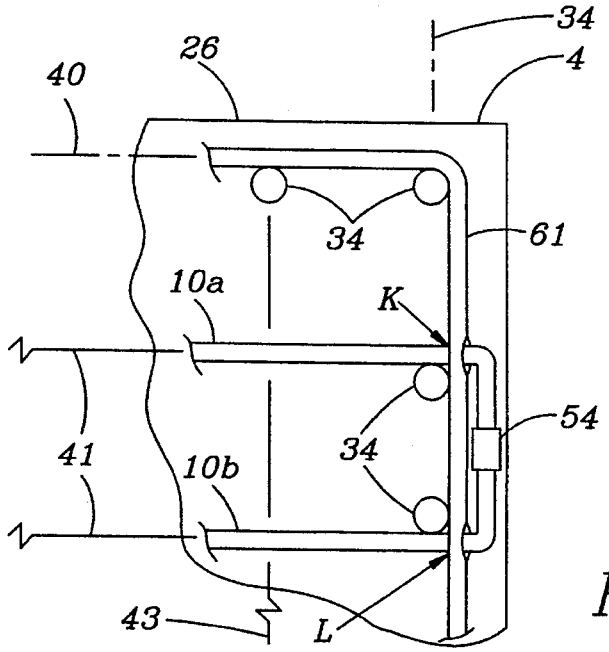
FIG. 4 illustrates a connection between a border piece and the double back transverse strand of the mesh structure shown in FIG. 3 as seen from the right side of the mesh.

As illustrated in FIG. 4, the free ends of the transverse strand lengths **10*a*,10*b* are also caused to pierce the border member 4 at points k and l along the opposite side 61 of the border from where the strand lengths 10*a*,10*b* were initially introduced through the border as discussed with reference to FIG. 3. The free ends of the strand lengths 10*a*, 10*b* are turned at right angles and secured together by a commercially available deformable metallic sleeve 54 which is crimped onto the overlapping ends of the strands. Alternatively, in the case where the user desires the option of on-site fabrication due to the possibility that the D1 dimension may need to be varied when the mesh put into place in the actual environment in which it is to be used, the free ends of the transverse strand lengths 10*a*,10*b* can in such instances be thus left unattached to the border member which allows the assembler the option of clamping the free ends of the transverse strands to the border or allow the assembler the option of cutting the transverse strand lengths and thereafter crimp the free ends of the transverse strands to the outermost one of the longitudinal strand lengths 8*a*,8*b*** in the same manner by which these free ends would otherwise connect to the border member.

Figure 5:
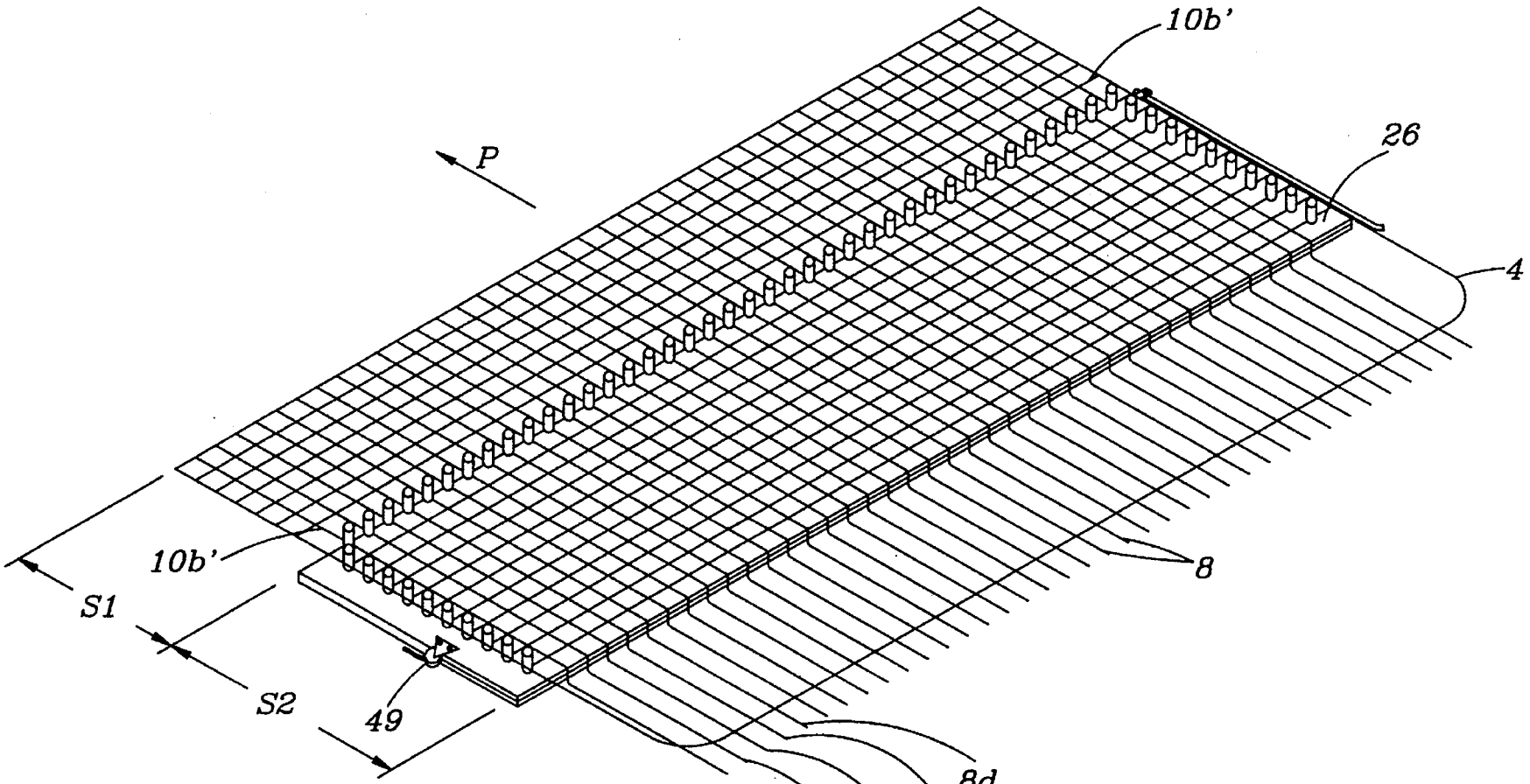
FIG. 5 is a perspective view of the jig of FIG. 2 shown in the fabrication process wherein a mesh structure is created in a segment by segment manner.

Referring now to FIG. 5, it should be seen that following the assembly of the first segment of the mesh structure referenced as S1, the first and second clamp 49 and 51 means are then released and the thus fabricated segment S1 of the length L of the mesh structure is lifted upwards and over the peg members 34,34 and advanced in the indicated direction P such that the trailing one of the transverse strand length **10*b*' abuts the outer perimeter of the third row 40 of the peg members 34,34. It is against this trailing strand length 10***b*' that the longitudinal strands of the next segment S2 are pulled tautly and then clamped by the first clamp means 49. Thereafter, the process of creating the transverse strands 10,10 is repeated by again looping a given length of strand about two consecutive ordered peg members in a selected one of the rows 36 and 38 and causing these doubled back strands to be transversely pierced by the longitudinally aligned strands 8,8. This process is continued until the length L of the mesh structure is achieved by fabricating successive segments S1, S2, S3 . . . corresponding to the number of multiples that the length L of the mesh structure is divisible by the dimension D2. Once this occurs, the free ends of the longitudinal strands 8,8 are caused to pierce the end 59 of the border member 2 and are thereafter caused to be crimped together in the manner discussed above with reference to FIG. 4.

By the foregoing, the strands which are considered to be deferred in the use of the fabrication of the above-referenced structure are disclosed as being eye strengths steel cable which is capable of being pierced by pulling apart some of the twisted fibers to effect piercing. However, such material may also take the form of hemp rope or the like which are similarly capable of being pierced in that manner. Accordingly, the invention has been described by way of illustration rather than limitation.

I claim:

1. A mesh structure comprising:

a border member having a first given dimension taken in one direction and a second given dimension taken in a second direction wherein said first and second dimensions define the general shape of the mesh structure;

a plurality of longitudinal and transverse strands, each of said longitudinal strands being disposed generally parallel to one another and to said first given dimension of said border member and each of said transverse strands being disposed parallel to one another and to said second dimension of said border member such that the longitudinal strands and the transverse strands together intersect one another at given intervals;

consecutively ordered pairs of said transverse strands and consecutively ordered pairs of said longitudinal strands each being comprised of a single strand length doubled back on itself so as to form an intermediate strand length disposed generally orthogonally to the doubled back strand lengths of the involved single strand length, said doubled back strand lengths of each of said transverse strands extending with said first given dimension and said doubled back strand lengths of each of said longitudinal strands extending with said second given dimension, each consecutively ordered pair of said transverse strands and each consecutively ordered pair of said longitudinal strands being connected to said border member such that the doubled back strand lengths of each of said consecutively ordered pair of said transverse strands and each consecutively ordered pair of said longitudinal strands connect with the border member at two spaced points corresponding to the length of the intermediate strand length associated with each consecutively ordered pair of said transverse strands and each consecutively ordered pair of said longitudinal strands;

fastening means for interconnecting said transverse and said longitudinal strands to one another at the intersections thereof; and means for securing the free ends of said consecutively ordered pair of said transverse strands and free ends of said consecutively ordered pair of said longitudinal strands to said border member or to a juxtaposed transverse strand or longitudinal strand.

2. A mesh structure as defined in claim 1 further characterized by said border member being defined by a continuous length of twisted cable turned at ninety degrees at four corners to create a general quadrilateral shape, and each consecutively ordered pair of said transverse strands and each consecutively ordered pair of said longitudinal strands being connected to said border member by piercing the cable at locations corresponding to the length of the intermediate strand length associated with each consecutively ordered pair of said transverse strands and each consecutively ordered pair of said longitudinal strands respectively.

3. A mesh structure as defined in claim 2 further characterized by each of said longitudinal strands being formed from a single length of twisted cable which is pierced by each of said transverse strands at said intersections thereof and said fastening means for interconnecting said transverse and said longitudinal strands to one another at locations thereon corresponding generally to the length of said intermediate strand length associated with each consecutively ordered pair of said transverse strands.

4. A mesh structure as defined in claim 3 further characterized by said means for securing the free ends of said longitudinal strands includes a means for deformably clamping each free end of said longitudinal strands together after said each free end of said longitudinal strands pierce an associated border length and are turned ninety degrees from the point where the longitudinal strand exits the border member and becomes clamped in a generally parallel orientation with respect to the associated border length through which it pierced,

5. A mesh structure as defined in claim 4 further characterized by each of said transverse and longitudinal strands being twisted steel cable and said piercing of said longitudinal strands occurs by pulling the twisted steel cable apart and threading the involved transverse strands therethrough.

6. A mesh structure as defined in claim 5 further characterized by said fastening means for interconnecting said transverse and said longitudinal strands to one another at the intersections thereof includes a deformable metallic clip member which is fastened around intersecting ones of the transverse and longitudinal strands.

7. A mesh structure as defined in claim 5 further characterized by said means for securing the free ends of said transverse strands includes a means for deformably clamping each free end of said transverse strands together after said each free end of said transverse strands pierce an associated border length and is turned ninety degrees from the point where the transverse strand exits the border member and becomes clamped in a generally parallel orientation with respect to the associate border length through which they pierced.

8. A mesh structure as defined in claim 5 further characterized by said means for securing the free ends of said longitudinal strands includes a deformable sleeve which is sufficiently internally sized to receive both free ends of the longitudinal strands and thereafter be crimped thereabout.

9. A mesh structure as defined in claim 4 further characterized by said means for securing the free ends of said longitudinal strands includes a deformable sleeve which is sufficiently internally sized to receive both free ends of the longitudinal strands and thereafter be crimped thereabout.

* * * * *